US009008562B2

(12) United States Patent
Yamaguchi et al.

(10) Patent No.: US 9,008,562 B2
(45) Date of Patent: Apr. 14, 2015

(54) ERASING APPARATUS

(71) Applicants: Kabushiki Kaisha Toshiba, Tokyo (JP); Toshiba Tec Kabushiki Kaisha, Tokyo (JP)

(72) Inventors: Yoichi Yamaguchi, Shizuoka-ken (JP); Yoshihisa Hashimoto, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/025,275

(22) Filed: Sep. 12, 2013

(65) Prior Publication Data

US 2014/0093293 A1 Apr. 3, 2014

(30) Foreign Application Priority Data

Sep. 28, 2012 (JP) ..... 2012-216966

(51) Int. Cl.
*G03G 21/14* (2006.01)
*G03G 21/00* (2006.01)
*B41J 2/32* (2006.01)

(52) U.S. Cl.
CPC ..... *G03G 21/14* (2013.01); *G03G 21/00* (2013.01); *B41J 2/32* (2013.01); *B41J 2202/37* (2013.01)

(58) Field of Classification Search
None
See application file for complete search history.

(56) References Cited

U.S. PATENT DOCUMENTS 6,296,713 B1 * 10/2001 Sugie et al. ..... 134/1
2008/0266588 A1 10/2008 Inaba
2009/0154970 A1 * 6/2009 Yoshida et al. ..... 399/341
2012/0306985 A1 12/2012 Iguchi et al.

FOREIGN PATENT DOCUMENTS

JP 2012-123375 6/2012
JP 2012-229077 11/2012

OTHER PUBLICATIONS

Office Action dated May 20, 2014, filed in corresponding Japanese Patent Application No. 2012-216966, with English translation.

* cited by examiner

*Primary Examiner* — Clayton E LaBalle
*Assistant Examiner* — Jas Sanghera
(74) *Attorney, Agent, or Firm* — Patterson & Sheridan LLP

(57) ABSTRACT

An erasing apparatus comprises a detection section configured to detect whether or not a sheet is set in a sheet supplying section, and a storage section configured to store processing information identifying one or more processes to be carried out on the sheet by the erasing apparatus. The erasing apparatus further comprises a control section configured to control a power supply of a heating element of an erasing section to be on when the detection section detects that a sheet is set in the sheet supplying section and when the one or more processes identified in the processing information includes erasing processing, and control the power supply of the heating element to be off when the detection section detects that a sheet is set in the sheet supplying section and when the one or more processes identified in the processing information does not include erasing processing.

20 Claims, 6 Drawing Sheets

ERASING APPARATUS

CROSS-REFERENCE TO RELATED APPLICATION

This application is based upon and claims the benefit of priority from Japanese Patent Application No. 2012-216966, filed Sep. 28, 2012, the entire contents of which are incorporated herein by reference.

FIELD

Embodiments described herein relate to technology for controlling the consumed power of an erasing apparatus.

BACKGROUND

In order to reduce consumed power, an apparatus may transition to a state of reduced power consumption when not being used by a user. The state of reduced power consumption is called a sleep state and is used in various devices.

In addition, an erasing apparatus that erases the image formed of special toner on a sheet by heating at a certain temperature is also well-known.

DETAILED DESCRIPTION

An erasing apparatus according to an embodiment comprises a detection section configured to detect whether or not a sheet is set in a sheet supplying section, and a storage section configured to store processing information identifying one or more processes to be carried out on the sheet by the erasing apparatus. The erasing apparatus further comprises a control section configured to control a power supply of a heating element of an erasing section to be on when the detection section detects that a sheet is set in the sheet supplying section and when the one or more processes identified in the processing information includes erasing processing, and control the power supply of the heating element to be off when the detection section detects that a sheet is set in the sheet supplying section and when the one or more processes identified in the processing information does not include erasing processing.

Hereinafter, each embodiment is described with reference to the accompanying drawings. In descriptions below, the sheet is described as a paper medium, but shall not be limited to the examples of embodiment, and the sheet may be also a plastic material, or a fabric material and the like.

A First Embodiment

Figure 1:
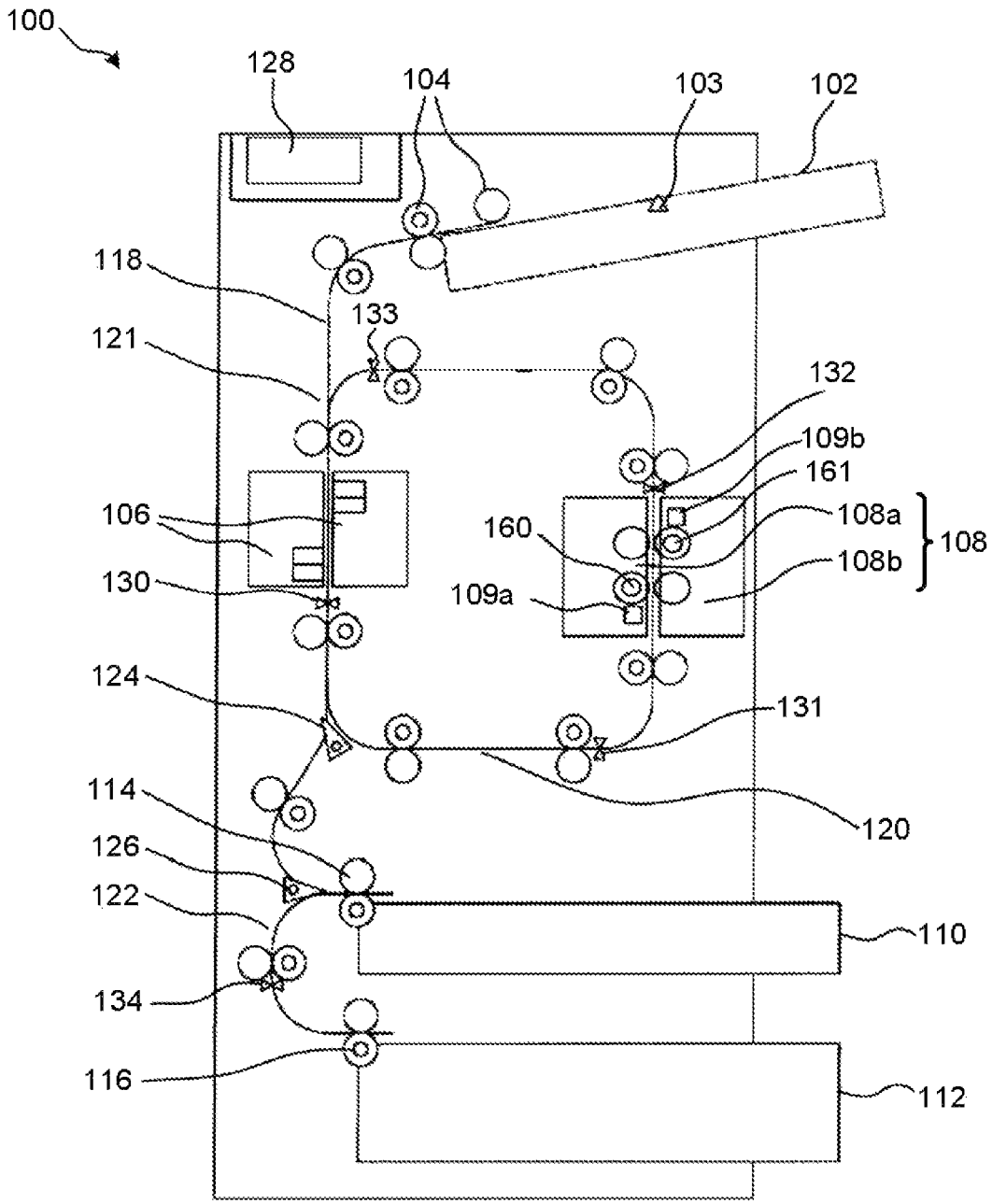
FIG. 1 is a diagram illustrating an example hardware configuration of an erasing apparatus according to one embodiment.

FIG. 1 is a diagram illustrating the configuration of the erasing apparatus. The erasing apparatus 100 carries out the "erasing processing" of erasing an image which is formed on a sheet using "erasable material" such as an erasable toner or erasable ink and the like. The erasable material includes a color generation compound, a color developing agent and an erasing agent. For the color generation compound, for example, a leuco dye can be used. For the color developing agent, for example, a phenol group can be used. For the erasing agent, a substance which compatibilizes with the color generation compound (i.e., a substance which can be mixed completely with the color generation compound at the molecular level) if heated and which does not have affinity with the color developing agent can be used. The erasable material develops the color by the interaction of the color generation compound and the color developing agent. The erasable material is erased when the color generation compound and the color developing agent is heated above an erasing temperature.

The erasing apparatus 100 comprises the paper feed tray 102 (sheet supplying section), a paper supplying component 104, a reading section 106, an erasing section 108, a first tray 110, a second tray 112, discharge components 114 and 116, a first conveyance path 118, a second conveyance path 120, a third conveyance path 122, a first switching component 124, a second switching component 126 and the operation section 128.

Figure 2:
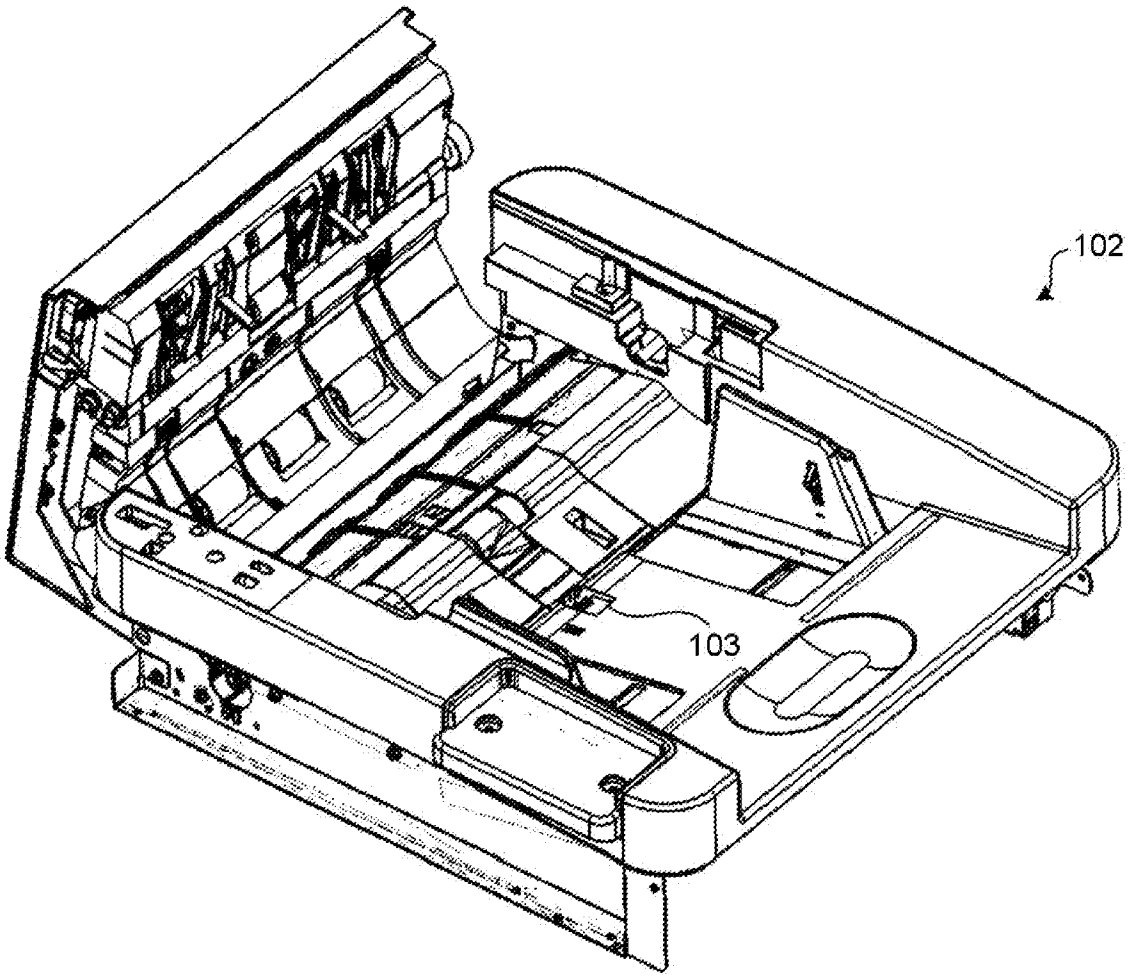
FIG. 2 is a perspective view illustrating a paper feed tray of the embodiment and indicating the position of a detection sensor according to the embodiment.

The paper feed tray 102 loads the sheet for reuse. The paper feed tray 102 loads the sheet in various sizes, such as A4, A3, B5 and the like. The sheet loaded by the paper feed tray 102, for example, is the sheet on which an image formation is carried out using the erasable material heated above a specified temperature. The paper supplying component 104 comprises a pickup roller, a sheet supplying roller, a separation roller configured opposite to the sheet supplying roller and the like, and supplies the sheet on the paper feed tray 102 one by one to the first conveyance path 118 inside the erasing apparatus 100. In addition, the paper feed tray 102 comprises a detection sensor 103 detecting the existence of the sheet on the paper feed tray 102. The position of the detection sensor 103 in the paper feed tray 102 is shown in FIG. 2. The detection sensor 103 is located near the center of the paper feed tray 102 and detects the loading of the sheet. The detection sensor 103, for example, may be a micro sensor or a micro actuator.

The first conveyance path 118 constitutes a conveyance path from the paper feed tray 102 to the first tray 110. The first conveyance path 118 conveys the fed sheet to the reading section 106 or to the first tray 110.

The reading section 106 is positioned at the downstream side of a sheet conveyance direction along the first conveyance path 118 for the paper feed tray 102. The reading section 106, for example, comprises a reading unit such as a CCD (Charge Coupled Device) scanner or a CMOS sensor and the like. In the present embodiment, the reading section 106 reads the respective images of the first surface and the second surface of the conveyed sheet. Namely, the reading section 106 includes two reading units which are along the first conveyance path 118. The reading units are configured to clamp the conveyance path, and can read the image on both surfaces of the conveyed sheet. The position at which the reading section 106 reads the image of the sheet is called a reading position. The image read by the reading section 106 is stored in the storage section 210 (referring to FIG. 3), which will be described later in detail. For example, image data can be acquired if the data of the erased image is needed later by digitizing the image on the sheet read by the reading section 106 and storing the digitized image in the storage section before erasing processing. In addition, the control section 200, which will be described later in detail, determines whether or not the sheet is erasable or whether or not the sheet is a reusable sheet based on the image read by the reading section 106.

The first switching component 124 as a switching section is located at the downstream side of the reading section 106. The first switching component 124 switches the conveyance direction of the conveyed sheet. The first switching component 124 conveys the sheet conveyed in the first conveyance path 118 to the second conveyance path 120 or to the first tray 110. The second conveyance path 120 is connected with the first conveyance path 118 at a switching point on which the first switching component 124 is configured. The second conveyance path 120 extends from the switching point and conveys the sheet to the erasing section 108. In addition, the second conveyance path 120 merges with the first conveyance path 118 at a merge point 121 which is located in the conveyance direction at a position more upstream than the reading section 106. That is, the second conveyance path 120 merges with the first conveyance path 118 at the merge point 121 between the paper feed tray 102 and the reading section 106. Consequently, the second conveyance path 120 may convey the sheet conveyed from the reading section 106 to the reading section 106 again through the erasing section 108. In other words, the erasing apparatus 100 can control the first switching component 124 to convey the sheet supplied by the paper supplying component 104 to the reading section 106, the erasing section 108 and the reading section 106 in sequence.

The first conveyance path 118 comprises the second switching component 126 at the downstream side of the first switching component 124. The second switching component 126 guides the sheet conveyed from the first switching component 124 to the first tray 110 or the third conveyance path 122. The third conveyance path 122 conveys the sheet to the second tray 112.

The erasing section 108 erases the color of the image of the conveyed sheet. For example, the erasing section 108 erases the color of the image formed on the sheet from the erasable material by heating the sheet to a specified erasing temperature in a state of being in contact with the conveyed sheet. The erasing section 108 comprises two erasing units 108*a* and 108*b* for erasing for the first surface and the second surface of the sheet. The erasing units 108*a* and 108*b* respectively comprise the heater lamps 160 and 161 (heating elements) heating when supplied with the power, and face each other across the second conveyance path 120. The erasing unit 108*a* heats one side of the sheet by contacting one side of the sheet. The erasing unit 108*b* heats the other side of the sheet by contacting the other side of the sheet. Namely, the erasing section 108 erases the images on the two surfaces of the conveyed sheet in one conveyance. Positions where the erasing units 108*a* and 108*b* heat the sheet, namely, positions where the heater lamps 160 and 161 of the erasing units 108*a* and 108*b* heat the conveyed sheet to erase the color of the image, are called erasing positions. The erasing section 108 respectively comprises temperature sensors 109*a* and 109*b* detecting the temperatures of the heater lamps 160 and 161 of the erasing units 108*a* and 108*b*. The temperature sensors 109*a* and 109*b* can be contact-type or contactless-type.

The operation section 128, located at the upper portion of a main body of the erasing apparatus 100, comprises a display section of touch panel type and various operation keys. The operation keys, for example, may comprise a numeric keypad and the like. A user instructs the action according to the function of the erasing apparatus 100, such as the start of erasing or the reading of the image of the erasing sheet and the like. The operation section 128 displays the setting information or the action state and the log information of the erasing apparatus 100 or a message sent to the user. In addition, the operation section 128 is not limited to be configured on the main body of the erasing apparatus 100. For example, it may be a configuration operated by an operation section of an external apparatus connected with the erasing apparatus 100 though a network, or, the operation section may be a configuration which is independent from the main body of the erasing apparatus and operates the erasing apparatus 100 by wired or wireless communication. The operation section of the present embodiment can also be an operation section which can carry out the instruction of the processing or the reading of the information, and the like, on the erasing apparatus 100.

The discharge components 114 and 116 discharge the sheet to the first tray 110 and the second tray 112, and are placed above and below, respectively, at the lower portion of the main body. For example, the first tray 110 loads the reusable sheet on which the image is erased. The second tray 112 loads the sheet which is determined to be not reusable. Hereinafter, the first tray 110 is called as reuse tray, and the second tray 112 is called as reject tray. In addition, the reuse tray 110 and the reject tray 112 can also exchange the sheet as an accepted object. The setting of what kind of sheet each tray loads, i.e., the setting of the conveyance destination of the sheet, can be also set by the operation section 128. Depending on the setting, the second switching component 126 switches the conveyance path and guides the conveyed sheet to the first tray 110 or the third conveyance path 122. The erasing apparatus 100 comprises a plurality of sheet detection sensors 130, 131, 132, 133 and 134 for detecting the sheet conveyed in the first to the third conveyance paths 118, 120 and 122. The sheet detection sensors, for example, can be also micro sensors or micro actuators. The sheet detection sensors are located at the proper position of the conveyance path.

Figure 3:
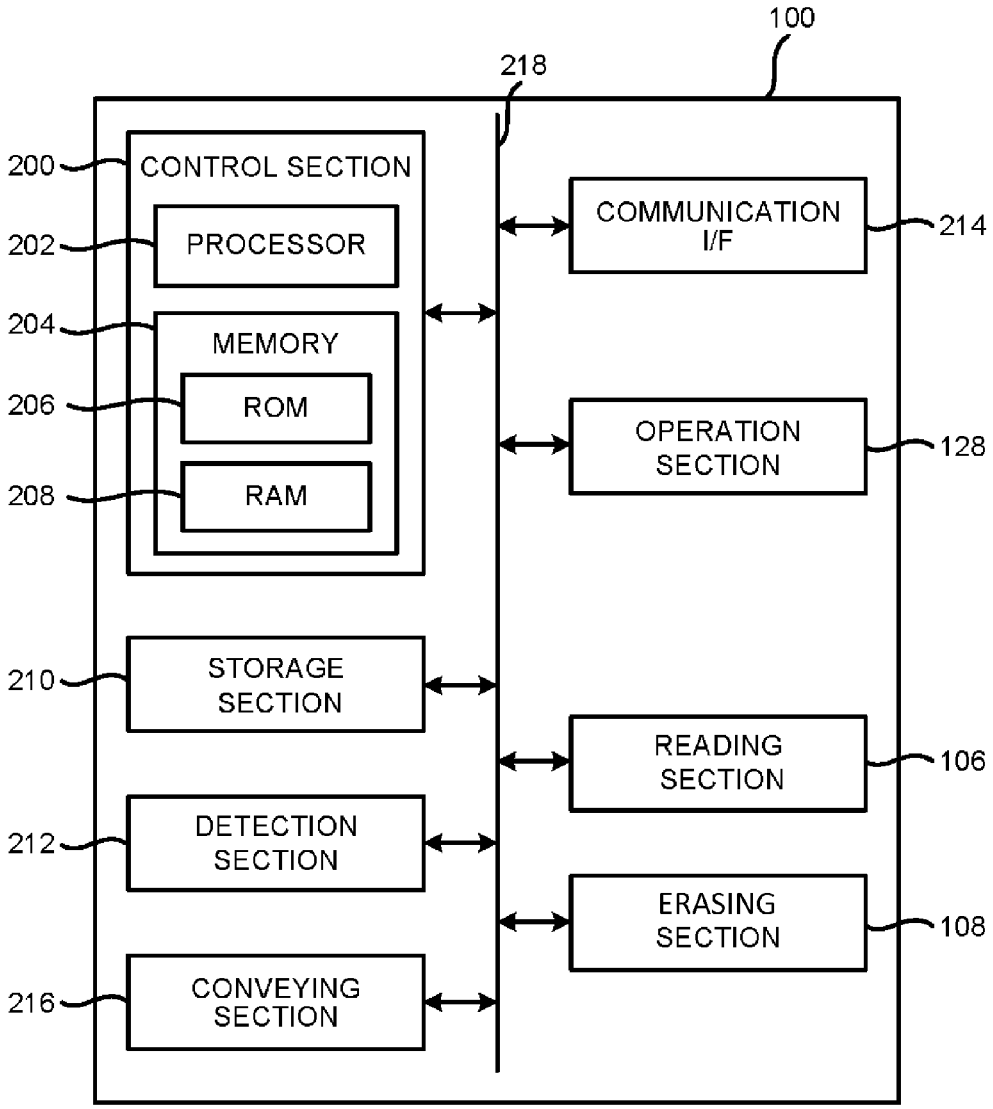
FIG. 3 is a block diagram of the erasing apparatus according to the embodiment.

FIG. 3 is a block diagram illustrating the hardware configuration of the erasing apparatus. The erasing apparatus 100 comprises the control section 200, the storage section 210, a detection section 212, a communication interface (communication I/F) 214, a conveying section 216, the reading section 106, the erasing section 108 and the operation section 128.

The control section 200 comprises a processor 202 including a CPU (Central Processing unit) or a MPU (Micro Processing unit) and a memory 204. The control section 200 controls the reading section 106, the erasing section 108 and the operation section 128. The memory 204, for example, is a semiconductor memory, and comprises a ROM (Read Only Memory) 206 storing various control programs and a RAM (Random Access Memory) 208 providing a temporary working area for the processor 202. For example, the ROM 206 stores the printing rate of the sheet as a threshold value determining whether or not the sheet is reusable, a density threshold value for determining whether or not the image is erased, and the like. The RAM 208 can also temporarily store the image read by the reading section 106. All components of the erasing apparatus 100 are connected via a bus 218.

The erasing apparatus 100, for example, includes reading processing, erasing processing, sorting processing and prior sorting processing.

The control section 200 of the erasing apparatus 100 controls the reading section 106, the erasing section 108 and other configuration according to the set processing. The ROM 206 may store various instructions for the control section 200, and such instructions are passed to RAM 208 as needed for the control section 200 to control various components and processes of the erasing apparatus 100. Alternatively, the instructions for the control section may be stored in the storage section 210, and are passed to RAM 208 as needed.

In reading processing, the control section 200 controls storage of the image read by the reading section 106 in the storage section 210 (referring to FIG. 2). In erasing processing, the control section 200 controls erasing of the image of the sheet by the erasing section 108.

In sorting processing, the control section 200 determines whether or not the sheet is reusable according to the image read by the reading section 106. For example, in sorting processing, the control section 200 determines whether or not the image exists on the sheet according to the data read by the reading section 106, and determines that the sheet is not-reusable when the image exists. For example, when the sheet subjected to the erasing processing by the erasing section 108 is read, in a condition that a residual image exists and is not fully erased, i.e., an erasing residue remains, the control section 200 determines that the sheet is not-reusable. In addition, in sorting processing, the control section 200 determines a corrugation depth and the existence of fracture or breakage according to the data read by the reading section 106. When the corrugation depth is above a specified value or a fracture, breakage or hole is determined to exist, the erasing apparatus 100 determines that the sheet is not-reusable.

In prior sorting processing, the control section 200 determines the printing rate of the image on the sheet according to the data read by the reading section 106 before the erasing processing. When the printing rate is above the specified value, the control section 200 does not execute the erasing processing and determines that the sheet is not-reusable. The control section 200 controls discharge of the sheet determined to be not-reusable to the reject tray 112. The control section 200 can also determine whether or not prohibition data indicating that erasing should be prohibited, such as confidential data and the like, is included in the data of the sheet image read by the reading section 106. When the data indicating that erasing should be prohibited is included, the control section 200 controls conveyance of the sheet to the reject tray 112.

Figure 4:
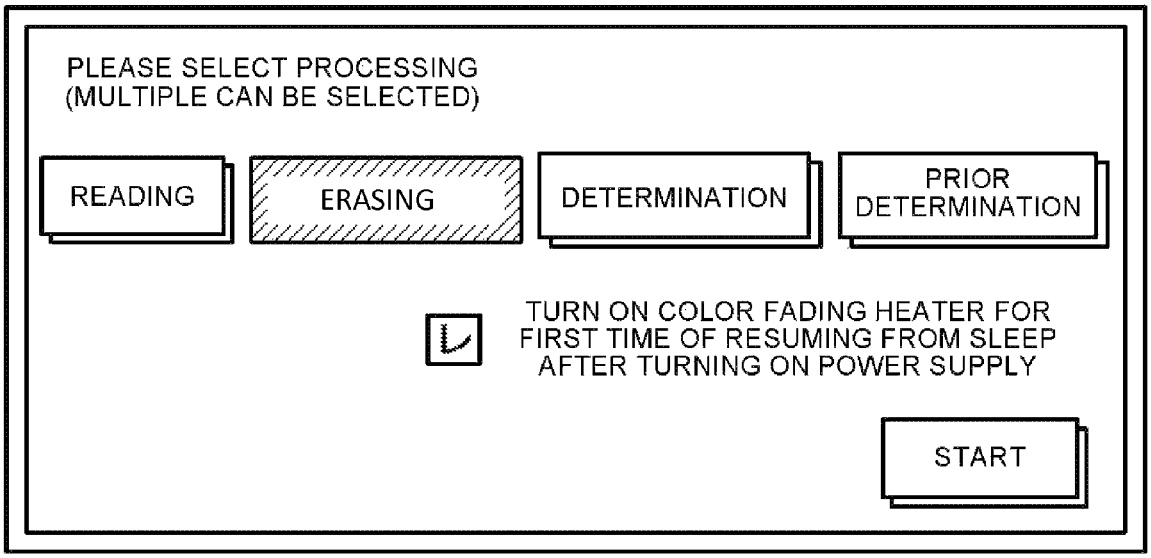
FIG. 4 is a diagram illustrating an example of a menu screen displayed by an operation section according to the embodiment.

The selection of the processing can be set by the operation section 128 of the erasing apparatus 100. FIG. 4 illustrates a display example of a menu screen of the operation section 128. The user executes the processing by pressing each button of the menu screen. For example, as shown in the example in FIG. 4, the control section 200 only carries out the erasing processing on the sheet when only a "erasing" button is pressed. In addition, for example, when a "reading" button and the "erasing" button are pressed, the control section 200 controls each appropriate unit/section, so as to execute the selected processing including reading processing and erasing processing. In this way, reading processing, erasing processing, sorting processing or prior sorting processing may be properly combined as selected through the operation section 128.

In addition, in the erasing apparatus 100 of the present embodiment, when the different processing mentioned above are combined, as an example, the processing is preferentially executed according to the sequence of reading processing, erasing processing and sorting processing. In addition, the priorities of reading processing and prior sorting processing are set to be equal. For example, when reading processing, erasing processing and sorting processing are each selected, the erasing apparatus 100 carries out the processing according to the sequence of: reading processing by the reading section 106, erasing processing by the erasing section 108, and sorting processing by the reading section 106. Namely, before the erasing section 108 carries out the erasing on the image of the sheet, the image of the sheet is read by the reading section 106, and after the erasing section 108 carries out the erasing on the image of the sheet, the reading section 106 reads the erased image of the sheet. When prior sorting processing, erasing processing and sorting processing are selected, the erasing apparatus 100 carries out the processing according to the sequence of: prior sorting processing by the reading section 106, erasing processing by the erasing section 108, and sorting processing by the reading section 106. When reading processing and prior sorting processing are selected, the erasing apparatus 100 simultaneously carries out reading processing and prior sorting processing based on the printing rate according to the data read by the reading section 106.

In addition, a check box is located in the menu screen shown in FIG. 4. The check box shows whether or not to supply power to the heater lamps 160 and 161 of the erasing section 108 is turned on when the erasing section 108 resumes from sleep for the first time after power supply to the erasing apparatus is turned on. When a mark is added in the check box, after the erasing apparatus 100 is started, the heater lamps 160 and 161 are turned on and are supplied with power for first time after resuming from sleep.

The selected state of each button of these "reading" button, "erasing" button, "determination" button and "prior determination" button and the setting of the check box are stored in the RAM 208 or the storage section 210 as flag data (first information) when the user carries out an operation. The control section 200 acquires the flag data from the RAM 208 or the storage section 210 when the "start" button is pressed, and determines the selected processing according to the flag data.

In addition, the erasing apparatus 100 is not limited to the embodiment in which the user properly selects the processing mentioned above. For example, the erasing apparatus 100 can also have various processing modes, each of which includes a predetermined combination of processes, and a user selects one of the processing modes. The control section 200 of the erasing apparatus 100 changes the conveyance path of the sheet according to the selected processing. In addition, the selection of the executed processing is not limited to the operation section 128 of the erasing apparatus 100, and can be also set from an external terminal.

The control section 200 controls various components inside the apparatus according to a signal from the detection section 212. The detection section 212 comprises the detection sensor 103, the temperature sensors 109*a* and 109*b*, the sheet detection sensors 130, 131, 132, 133 and 134, and the like, which are shown in FIG. 1. The control section 200 receives a signal (detection information) from the detection sensor 103, and determines the existence of a sheet on the paper feed tray 102 according to the signal. In addition, the control section 200 uses the temperature sensors 109*a* and 109*b* to detect the temperatures of the heater lamps 160 and 161 of the erasing units 108*a* and 108*b*. Based on the detected temperature, the control section 200 controls the temperatures of the heater lamps 160 and 161. In addition, the control section 200 uses the sheet detection sensors 130, 131, 132, 133 and 134 to acquire the positions of the sheet in the first to the third conveyance paths 118, 120 and 122. For example, the control section 200 uses the sheet detection senor 130 near the downstream side of the reading section 106 to detect the sheet passing through the reading section 106.

The storage section 210 stores an application program and an operating system (OS). The application program includes a program for executing the functions of a erasing apparatus, such as a reading function of the reading section 106 and the erasing function of the erasing section. The application program further comprises a Web client-oriented application (Web browser) or other application. The storage section 210 stores the image read by the reading section 106. In addition, the storage section 210 stores the processed number of the sheet processed by the erasing apparatus 100. The storage section 210, for example, may be a hard disc drive, another magnetic storage apparatus, an optical storage apparatus, a semiconductor storage apparatus such as a flash memory and the like or any combination thereof.

The communication I/F 214 is an interface that connects the control section with an external machine. The communication I/F 214, for example, carries out communication with the external apparatus on the network through a proper wireless or wired communication, for example via IEEE802.15, IEEE802.11, IEEE802.3, IEEE3304 and the like, Bluetooth®, infrared connection, an optical connection or any other suitable communication protocol. The communication I/F 214 can also include a USB connecting section, a parallel interface, and the like, connected with a connecting terminal. The control section 200 carries out communication with a compound machine and other external machine through the communication I/F 214.

The image read by the reading section 106 is stored by the storage section 210 of the erasing apparatus 100 according to an embodiment, but is not limited to that. For example, the communication can be also carried out with a user terminal (personal computer) serving as the external machine, the compound machine or a server through the communication I/F 214, and the image is communicated to and stored in the storage section of these external machines. Such a configuration is within the scope of the present disclosure so long as the image data stored in the external machine can be read out from the operation section of the compound machine or the user terminal. In addition, if the erasing apparatus 100 includes login and logout functions for carrying out personal identification, the data of the image stored by the RAM 208 or the storage section 210 of the erasing apparatus 100 can be also sent to the external apparatus and stored before or upon logout of the erasing apparatus 100.

The conveying section 216 comprises a plurality of conveyance rollers configured on the first conveyance path 118, the second conveyance path 120 and the third conveyance path 122, and a conveyance motor driving the conveyance rollers. The control section 200 controls the conveyance speed of the sheet by controlling the driving of the conveyance motor of the conveying section 216. In order to read the image of the sheet, the speed of the conveyed sheet in the reading section 106 is assumed to be a reading speed, and in order to erase the color of the image of the sheet, the speed of the conveyed sheet in the erasing section 108 is assumed to be a erasing speed.

The erasing apparatus 100 of the present embodiment is converted from a running state to the sleep state of being in a power saving manner, and in addition, can resume to the running state from the sleep state by the control of the control section 200. When it resumes from the sleep state, the heater lamps 160 and 161 of the erasing section 108 need a period of time to rise normal temperature to an erasing temperature. The erasing processing cannot be carried out during this period of time, therefore a user has to wait. Compared with a conventional erasing apparatus, the erasing apparatus described in the present embodiment may advance the start of resuming from sleep so as to mitigate the waiting time of the user.

Figure 5:
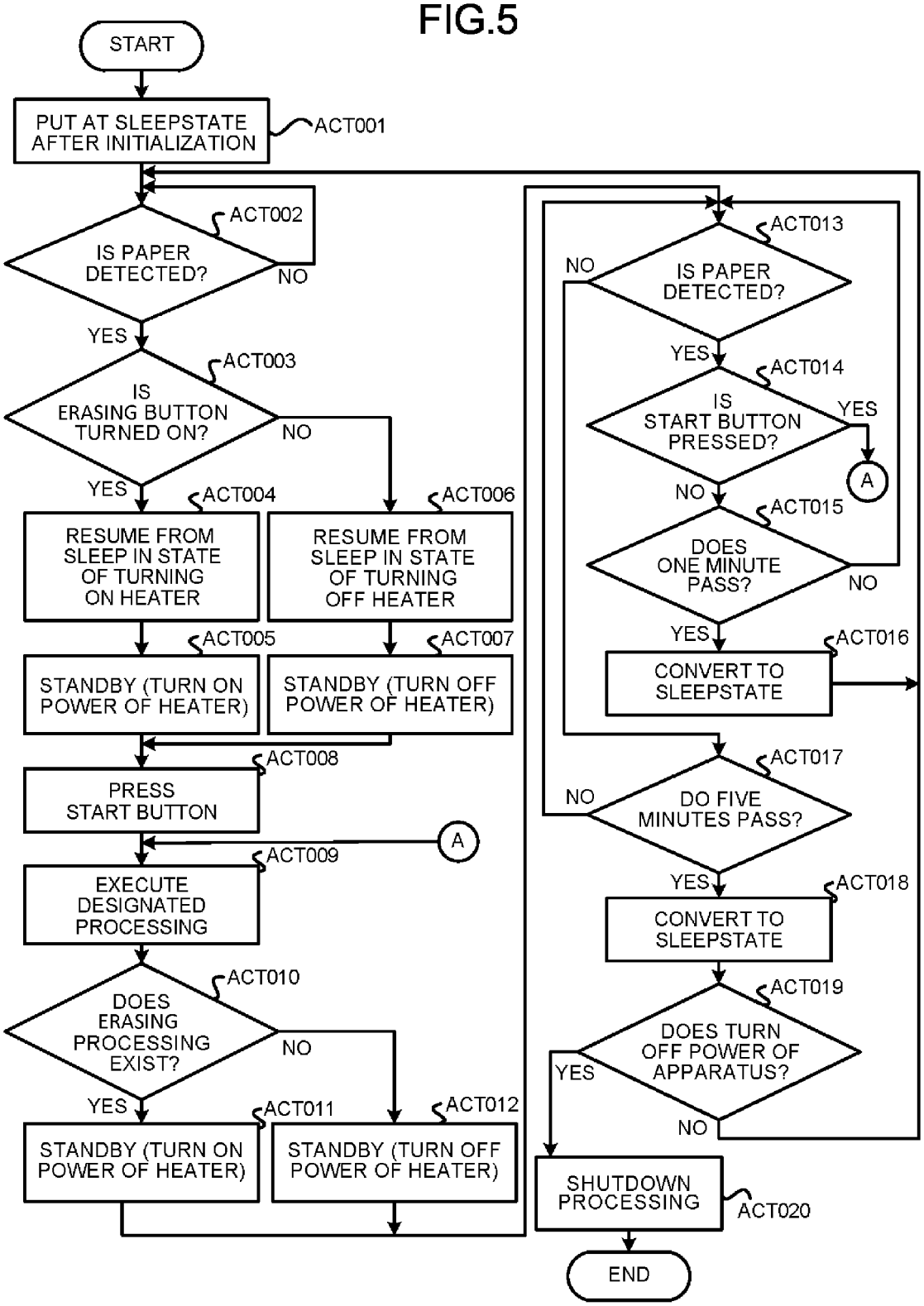
FIG. 5 is a flowchart illustrating example operations of the erasing apparatus according to the first embodiment.

FIG. 5 is a flowchart illustrating example operations of the erasing apparatus 100 according to the present embodiment. After the power of the erasing apparatus 100 is turned on, and the initialization processing is carried out, the control section 200 controls each hardware to be at a sleep state first (ACT001). In addition, the erasing apparatus can be in the running state within a certain period after the initialization processing, and afterwards, is then converted to the sleep state. The power supply to the heater lamps 160 and 161 is also reduced in the sleep state.

If the loading of the sheet is detected by the detection sensor 103 of the paper feed tray 102, the detection section 212 outputs the signal (detection information) to the control section 200. If the detection signal is received in the control section 200 (Yes in ACT002), the control section 200 determines whether or not the "erasing" button is turned on, i.e., whether erasing processing has been selected (ACT003). During the first time of execution after the power supply is turned on, the control section 200 determines whether or not a mark exists in the check box shown in FIG. 4, namely, whether or not the flag data related to the check box stored in the storage section 210 is a value indicating that the power to the heating section should be turned on upon exiting sleep mode. After a second time of execution, the determination is carried out according to the setting of the execution at the last time, namely, by observing whether or not the "erasing" button is pressed and the value denoting the carrying out of the erasing processing is included in the flag data.

Herein, when the "erasing" button is turned on (Yes in ACT003), the control section 200 turns on power supply to the heater lamps 160 and 161 and resumes each unit from sleep state. (ACT004). The control section 200 is in a state of being capable of executing other action in real time (ACT005). A heater temperature at the moment is maintained at approximately 100 degrees centigrade (or other specified standby temperature), so that it can be transitioned to the erasing temperature (about 150-160 degrees centigrade in the present example) in real time. The erasing temperature is reached in a certain time according to the temperature capable of erasing a toner image, time until the arrival to the erasing temperature, time from the pressing of the "start" button to the arrival of the sheet to the erasing section 108, and the like. In the present example, the specified standby temperature is set to be 100 degrees centigrade, but the embodiment is not limited to that.

On the other hand, when the "erasing" button is turned off (No in ACT003), the control section 200 turns off the power supply to the heater lamps 160 and 161 of the erasing section 108 and resumes from sleep state. (ACT006). The control section 200 controls other units except the heater lamps 160 and 161 to be in a standby state, i.e., in a state of being capable of acting in real time (ACT007).

In the standby state in ACT005 and ACT007 (although it is not limited to that, and can be any action after ACT001), if the "start" button is pressed (ACT008), the processing designated by the user is carried out. The processing is any one of reading processing, erasing processing, sorting processing and prior sorting processing mentioned above or the processing mode having a combination thereof, and is the processing designated by the user through the operation section 128.

After the processing designated by the user is ended, the control section 200 determines whether or not the erasing processing exists in the processing of ACT009 implemented at this time (ACT010). When the erasing processing exists (Yes in ACT010), the control section 200 controls the heater lamps 160 and 161 to be at the specified standby temperature, i.e., in a state of being capable of acting in real time while maintaining the power supply of the heater lamps 160 and 161 at 100 degrees centigrade (ACT011). This is because if erasing processing has been previously selected and is carried out, there is a high probability that erasing processing will continue to be selected and executed. On the other hand, in the processing of ACT009 executed at this time, if erasing processing does not exist (No in ACT010), the control section 200 turns off the power supply to the heater lamps 160 and 161 and the heater lamps 160 and 161 are set to be standby (ACT012).

Afterwards, the loading of the sheet is detected by the detection sensor 103 of the paper feed tray 102 (Yes in ACT013), and when the start button is pressed (Yes in ACT014), the control section 200 controls each unit to execute the action designated by the user (ACT009). In addition, when the processing designated by the user is changed, the changed processing is executed.

In addition, in a state that the sheet is loaded (Yes in ACT013), the start button is not pressed (No in ACT014), and one minute has passed from the end of the last processing of ACT009 (ACT015, Yes), the control section 200 converts each unit to the sleep state (ACT016). During the sleep state, the control section 200, as described above, also reduces the power supply to the heater lamps 160 and 161 of the erasing section 108. Afterwards, it resumes to ACT002. In addition, if one minute does not pass from the end of the last of the processing of ACT009, it resumes to the sorting processing of ACT013.

On the other hand, when the sheet is not detected in ACT013 (No in ACT013), the control section 200 determines whether or not five minutes has passed from the end of the processing of ACT009 (ACT017). Herein, if five minutes has not passed (No in ACT017), the processing is resumed to the determination of ACT013. On the other hand, if five minutes has passed (Yes in ACT017), the control section 200 converts each unit to the sleep state (ACT018).

When a signal denoting that the power of the erasing apparatus 100 is to be turned off is input (Yes in ACT019), the control section 200 carries out shutdown processing (ACT020), and ends. When a signal denoting that the power is to be turned off is not input (No in ACT019), it returns to ACT002. In order to be convenient for description, the detection of that power is turned off (ACT019) is illustrated as a next action of ACT018, but it is sometimes the action caused by the random operation of the user, and therefore, it is carried out asynchronous with each action shown in FIG. 5. Thus, in the present example, it becomes an action of returning to ACT002 after it is converted to the sleep state in ACT018, and the shutdown processing is executed according to the interrupt signal denoting that the power is to be turned off.

ACT013 to ACT018 are the operation steps transferring to the sleep state after one minute has passed when the sheet is loaded on the paper feed tray 102 and transferring to the sleep state after five minutes have passed when the sheet is not loaded on the paper feed tray 102. These one minute and five minutes are stored as parameters in the storage section 210 and can be designated by the user.

In addition, the resumption from sleep in the state that the sheet is loaded on the paper feed tray 102 is carried out by removing the sheet from the paper feed tray 102 once and configuring the sheet on the paper feed tray 102 again. The action is returned to ACT002 from ACT016 in the processing in FIG. 5, and is realized by carrying out ACT004 or ACT006 depending on the determination of ACT003.

The sleep state in ACT016 can be also be a state of turning on a light of the display area of the operation section 128 to display the menu screen and turning off the light of the display area of the operation section 128 after five more minutes passes from the start of the last execution. Thus, ACT016 in FIG. 5 becomes the processing of "maintain screen display and convert to sleep state", and afterwards, the processing is transferred to ACT017. When the light of the screen is turned off, it is turned back on when a touch panel detects any contact. If the light of the display area is turned off when the user wants to carry out operation by the operation section 128, the touch of the screen or the like needs to be carried out. In addition, a delay will occur from the start of the execution of displaying processing to actual displaying. Like the example mentioned above, if the light of the displaying of the menu screen is not turned off for five minutes, unnecessary user operation or delay can be reduced.

A Second Embodiment

The erasing apparatus of the second embodiment includes a function of carrying out the authentication for each user and allowing the use of the user if proper. In addition, the erasing apparatus of the second embodiment previously stores the information of which processing is selected and carried out at the last time in the storage section for each user, and reads the information as the default setting for execution when the user logs in. In addition, the hardware configuration, switching to the sleep state, control of the resuming from the sleep state, and the like, are the same as those of the first embodiment. Therefore, the descriptions (referring to FIG. 1-FIG. 5) herein are applicable to the second embodiment. In addition, the symbols of each unit also are the same as those of the first embodiment.

In the storage section 128 of the second embodiment, the identification information and the password of the user, and the flag data of the selected processing (reading processing, erasing processing, sorting processing and prior sorting processing) during the logout at the last time are stored in a manner of establishing correspondence. The data establishing the correspondence is called a user management table. The user management table reads in each value during the login, and updates a flag data column during the logout.

Figure 6:
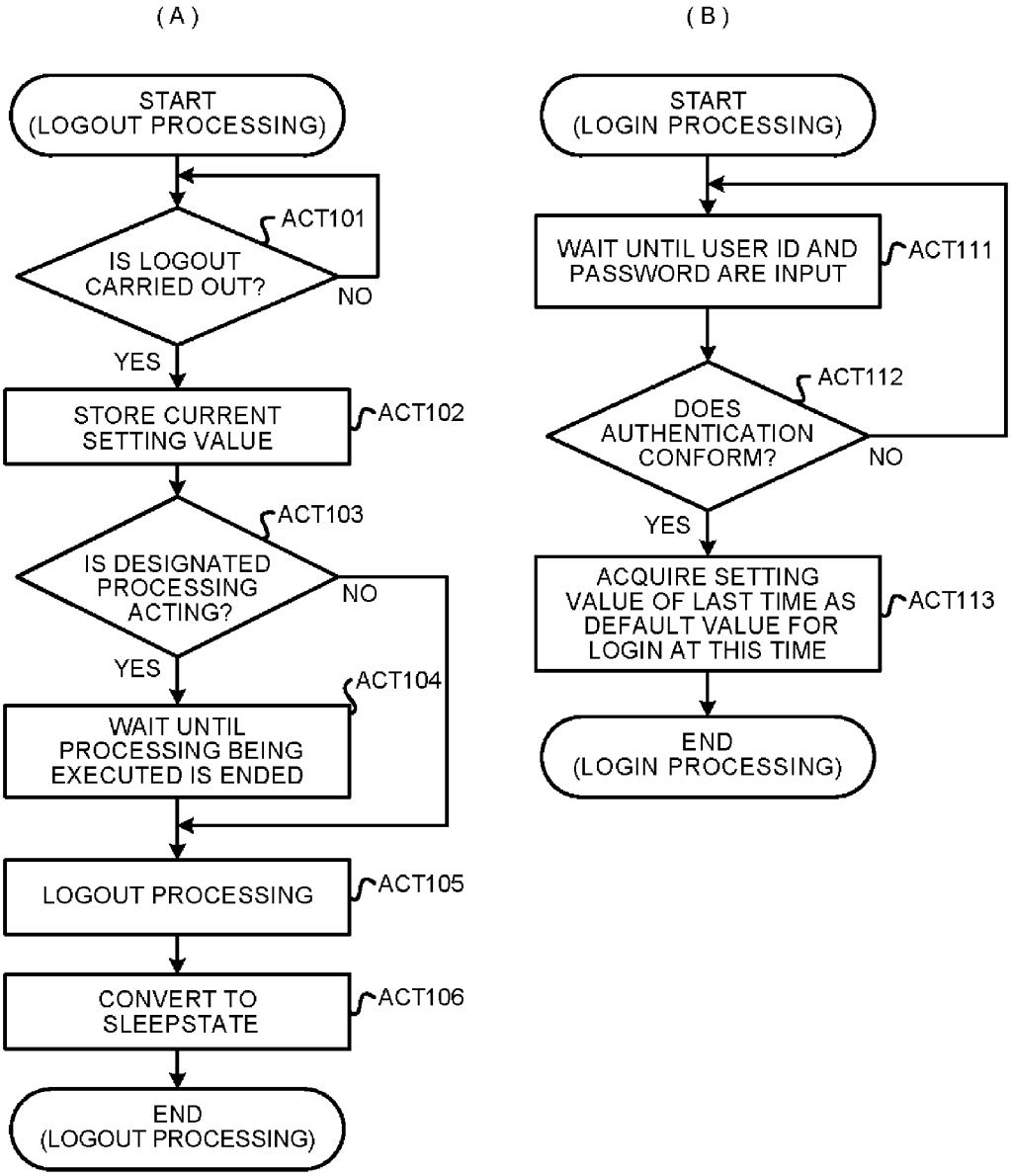
FIG. 6 is a flowchart illustrating example user logout and login operations of the erasing apparatus according to a second embodiment.

FIG. 6 is a flowchart illustrating example user logout and login operations according to the second embodiment.

FIG. 6(A) is a flowchart illustrating example operations when the user carries out the logout. The logout action is caused by the random operation of the user, and therefore, is carried out asynchronous with the flowchart shown in FIG. 5. The control section 200 determines whether or not a logout button (not shown) displayed by the operation section 128 is pressed (ACT101). When the logout button is pressed (Yes in ACT101), the control section 200 acquires the setting value (flag data) of the processing last selected by the current login user, extracts the record of the current login user from the user management table, and updates the flag data column according to the acquired value (ACT102). Herein, when the processing (reading processing, erasing processing, sorting processing and prior sorting processing) designated by the user is being executed (Yes in ACT103), the logout processing waits until the processing designated by the user is ended (ACT104). The control section 200 executes specified logout processing with respect to the current user such as storing other setting data (ACT105), and then controls each unit to the sleep state (ACT106). In addition, ACT102 can be also the installation carried out during ACT105.

FIG. 6(B) is a flowchart illustrating example operations of login processing when the erasing apparatus 100 is in the sleep state. The control section 200 controls the login processing to wait until the identification information and the password of the user are input (ACT111). When the light of the display area of the operation section 128 is turned off, and when the touch panel of the operation section 128 detects any contact, a screen for accepting the input of the identification information and the password of the user is displayed. The user can then input the appropriate identification information and password in the input screen.

The control section 200 retrieves the record of the user management table with the input identification information of the user, and carries out the authentication by comparing the password in the record with the input password. When the identification information and the password of the user are consistent and proper (Yes in ACT112), the control section 200 acquires the flag data of the last time of the processing from the retrieved record, and stores the flag data as the default value of the processing at this time in the RAM 208 or in a specified area of the storage section 210 (ACT113). Thus, the menu screen (referring to FIG. 4) displayed in the operation section 128 can be also displayed corresponding to a state of the processing selected and executed at the last time. When the start button is pressed in the state, the default value is adopted. Afterwards, the processing of ACT002 (or ACT003 when the sheet has already been loaded before the login) in FIG. 5 is carried out. In addition, the flag data related to the erasing processing of the default value become the determination elements of ACT003 in FIG. 5.

In the present example, the example that the user carries out the authentication by inputting the identification information and the password is described, but the card authentication can be also carried out when an IC card reader is mounted on the erasing apparatus 100.

In addition, in the present example, the flag data during the logout at the last time are used as the default value during the login, but it can be also the configuration that each value of the flag data (the value of the flag data when the logout is not stored) can be also fixed, and the fixed value is generally set as the default value during the login.

In the descriptions of the embodiment mentioned above, the "erasing processing" is described as the erasing of the color of the image, and can also include other processing for erasing of the image. Namely, the erasing apparatus of the embodiment is not limited to an apparatus for erasing the image by heat. For example, it can be also an apparatus for erasing the image on the sheet by the irradiation of light. It can be also an apparatus for erasing the image formed on special sheet. The erasing apparatus can be also an apparatus for eliminating the image on the sheet. In order to enable the sheet to be reusable, the erasing apparatus can also be a configuration enabling the image on the sheet to be invisible.

In addition, besides the storage section 210 of the embodiment, the "storage section" also includes the memory 204.

As described above in detail, in the embodiment, the resuming from the sleep state can be carried out at a stage earlier than before, and the waiting time of the execution of the processing designated by the user can be mitigated.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An erasing apparatus, comprising:

a detection section configured to detect whether or not a sheet is set in a sheet supplying section;

a storage section configured to store processing information identifying one or more processes to be carried out on the sheet by the erasing apparatus; and a control section configured to:

control a power supply of a heating element of an erasing section to be on and transition the erasing section from a sleep state to a standby state when the detection section detects that a sheet is set in the sheet supplying section and when the one or more processes identified in the processing information includes erasing processing, and control the power supply of the heating element to be off and transition the erasing section from the sleep state to the standby state when the detection section detects that a sheet is set in the sheet supplying section and when the one or more processes identified in the processing information does not include erasing processing.

2. The erasing apparatus according to claim 1, wherein the control section is configured to maintain the heating element that has been turned on at a specified temperature when the detection section detects that a sheet is set in the sheet supplying section and when the one or more processes identified in the processing information includes erasing processing.

3. The erasing apparatus according to claim 2, wherein the control section is configured to control the heating element that has been turned on to an erasing temperature that is higher than the specified temperature when the detection section detects that a sheet is set in the sheet supplying section, when the one or more processes identified in the processing information includes erasing processing, and when a start of processing is indicated by a user.

4. The erasing apparatus according to claim 3, wherein the control section is configured controls the heating element to be at the specified temperature after the erasing apparatus carries out the erasing processing.

5. The erasing apparatus according to claim 4, wherein the control section is configured to control the power supply of the heating element to be off when a predetermined amount of time elapses after the erasing apparatus carries out the erasing processing.

6. The erasing apparatus according to claim 1, wherein the one or more processes identified in the processing information are input by a specific user;

the processing information including the one or more processes input by the specific user are stored in the storage section as user information corresponding to the specific user; and the control section is further configured to authenticate the specific user, acquire the processing information associated with the specific user from the storage section after the specific user is authenticated, and set the one or more processes input by the specific user as a default setting for the one or more processes to be carried out on the sheet by the erasing apparatus.

7. The erasing apparatus according to claim 6, wherein the control section is configured to control the storage section to store the one or more processes input by the user as the user information corresponding to the specific user when a logout instruction is received.

8. An erasing apparatus, comprising:

a detection section configured to detect whether or not a sheet is set in a sheet supplying section;

an erasing section configured to perform erasing processing a sheet on which an erasable toner is printed, the erasing section including a heating element;

a storage section configured to store processing information identifying one or more processes to be carried out on the sheet by the erasing apparatus; and a control section configured to:

control a power supply of the heating element to be on and transition the erasing section from a sleep state to a standby state when the detection section detects that a sheet is set in the sheet supplying section and when the one or more processes identified in the processing information includes erasing processing, and control the power supply of the heating element to be off and transition the erasing section from the sleep state to the standby state when the detection section detects that a sheet is set in the sheet supplying section and when the one or more processes identified in the processing information does not include erasing processing.

9. The erasing apparatus according to claim 8, wherein the control section is configured to maintain the heating element that has been turned on at a specified temperature when the detection section detects that a sheet is set in the sheet supplying section and when the one or more processes identified in the processing information includes erasing processing.

10. The erasing apparatus according to claim 9, wherein the control section is configured to control the heating element that has been turned on to an erasing temperature that is higher than the specified temperature when the detection section detects that a sheet is set in the sheet supplying section, when the one or more processes identified in the processing information includes erasing processing, and when a start of processing is indicated by a user.

11. The erasing apparatus according to claim 10, wherein the control section is configured controls the heating element to be at the specified temperature after the erasing section carries out the erasing processing.

12. The erasing apparatus according to claim 11, wherein the control section is configured to control the power supply of the heating element to be off when a predetermined amount of time elapses after the erasing apparatus carries out the erasing processing.

13. The erasing apparatus according to claim 8, wherein the one or more processes identified in the processing information are input by a specific user;

the processing information including the one or more processes input by the specific user are stored in the storage section as user information corresponding to the specific user; and the control section is further configured to authenticate the specific user, acquire the processing information associated with the specific user from the storage section after the specific user is authenticated, and set the one or more processes input by the specific user as a default setting for the one or more processes to be carried out on the sheet by the erasing apparatus.

14. The erasing apparatus according to claim 13, wherein the control section is configured to control the storage section to store the one or more processes input by the user as the user information corresponding to the specific user when a logout instruction is received.

15. A non-transitory computer-readable medium containing instructions for controlling a power supply of an erasing apparatus, the erasing apparatus comprising a detection section configured to detect whether or not a sheet is set in a sheet supplying section; an erasing section configured to perform erasing processing a sheet on which an erasable toner is printed, the erasing section including a heating element; a storage section configured to store processing information identifying one or more processes to be carried out on the sheet by the erasing apparatus; and a control section, the instructions causing a control section to:

control a power supply of the heating element to be on and transition the erasing section from a sleep state to a standby state when the detection section detects that a sheet is set in the sheet supplying section and when the one or more processes identified in the processing information includes erasing processing, and control the power supply of the heating element to be off and transition the erasing section from the sleep state to the standby state when the detection section detects that a sheet is set in the sheet supplying section and when the one or more processes identified in the processing information does not include erasing processing.

16. The computer-readable medium according to claim 15, wherein the instructions further cause the control section to maintain the heating element that has been turned on at a specified temperature when the detection section detects that a sheet is set in the sheet supplying section and when the one or more processes identified in the processing information includes erasing processing.

17. The computer-readable medium according to claim 16, wherein the instructions further cause the control section to control the heating element that has been turned on to an erasing temperature that is higher than the specified temperature when the detection section detects that a sheet is set in the sheet supplying section, when the one or more processes identified in the processing information includes erasing processing, and when a start of processing is indicated by a user.

18. The computer-readable medium according to claim 17, wherein the instructions further cause the control section to control the heating element to be at the specified temperature after the erasing section carries out the erasing processing.

19. The computer-readable medium according to claim 18, wherein the instructions further cause the control section to control the power supply of the heating element to be off when a predetermined amount of time elapses after the erasing apparatus carries out the erasing processing.

20. The computer-readable medium according to claim 19, wherein the instructions further cause the control section to control the storage section to store the one or more processes input by the user as the user information corresponding to the specific user when a logout instruction is received.

* * * * *